US007497436B2

(12) United States Patent
Tocher

(10) Patent No.: US 7,497,436 B2
(45) Date of Patent: Mar. 3, 2009

(54) MEDIA CASSETTE PUSHER PLATE LOCKING MECHANISM

(75) Inventor: Alan Tocher, Edinburgh (GB)

(73) Assignee: NCR Corporation, Dayton, OH (US)

( * ) Notice: Subject to any disclaimer, the term of this patent is extended or adjusted under 35 U.S.C. 154(b) by 497 days.

(21) Appl. No.: 11/305,573

(22) Filed: Dec. 16, 2005

(65) Prior Publication Data

US 2007/0138263 A1 Jun. 21, 2007

(51) Int. Cl.
*B65H 1/00* (2006.01)

(52) U.S. Cl. ..... 271/162; 271/145; 271/147

(58) Field of Classification Search ..... 271/149, 271/147, 157, 145, 162, 164; 902/13; 109/19, 109/23, 24, 45–47
See application file for complete search history.

(56) References Cited

U.S. PATENT DOCUMENTS 7,240,899 B2 * 7/2007 Amamoto ..... 271/126
2003/0201597 A1 * 10/2003 Koh ..... 271/147

* cited by examiner

*Primary Examiner*—Patrick H Mackey
*Assistant Examiner*—Thomas A Morrison
(74) *Attorney, Agent, or Firm*—Michael Chan

(57) ABSTRACT

During transit of media cassettes there is a need to secure stacked media within the cassette to prevent this stack from moving and becoming disarrayed. Previously this has been achieved by using a pusher plate to urge the stack of media items to one end of the cassette by locking that pusher plate during transit. A ratchet bar is provided in the media cassette lid which engages with the pusher plate assembly to lock it during transit. The ratchet bar is coupled to a cam which is arranged to engage a dispenser when the media cassette is loaded into an ATM or similar. When the media cassette is inserted into the dispenser the cam automatically drives the ratchet bar which rotates and in so doing disengages the pusher plate assembly. By housing the ratchet bar in the media cassette lid, space savings are achieved and in addition, users are prevented from using the pusher plate locking mechanism to facilitate overfilling of the media cassette.

9 Claims, 10 Drawing Sheets

FIG. 7a
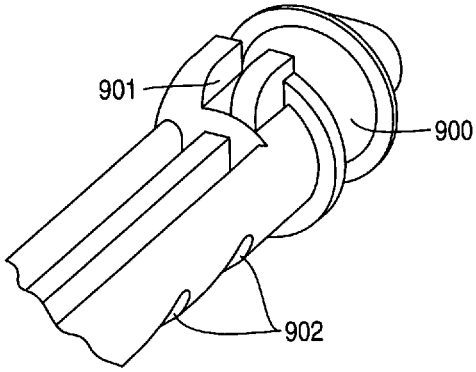
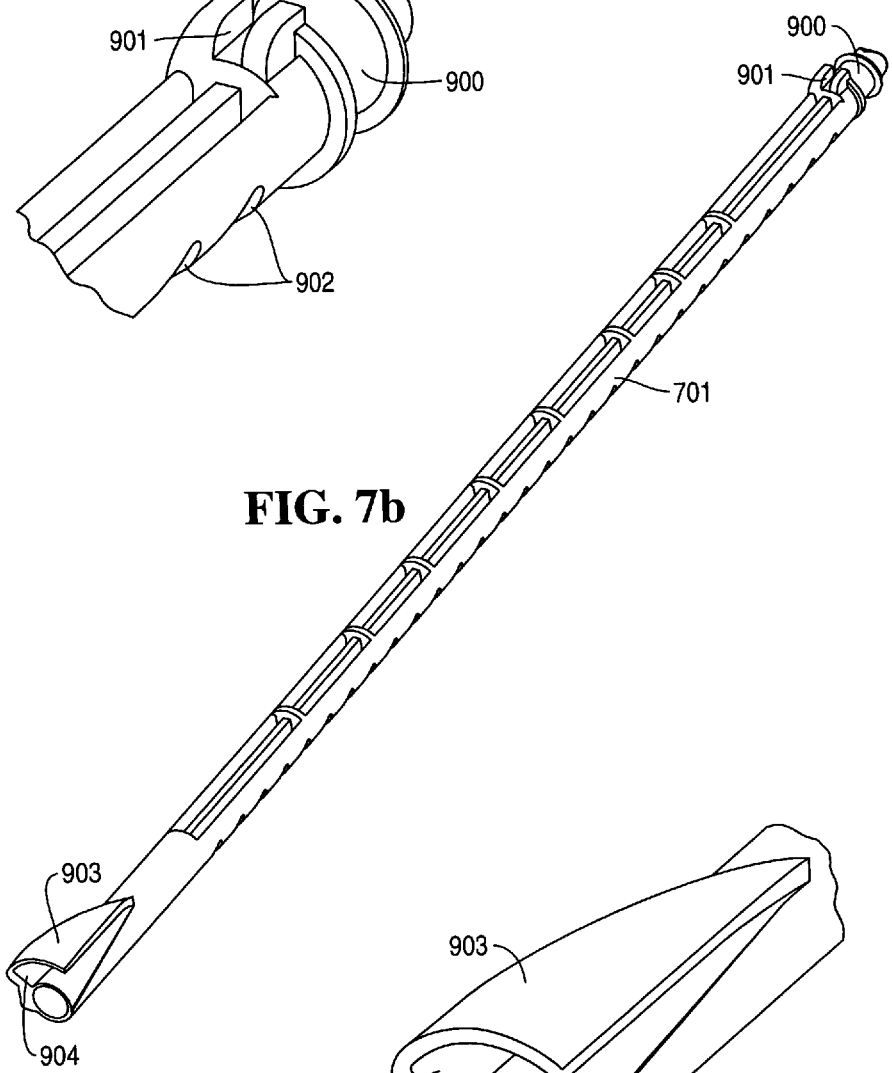
FIG. 7b
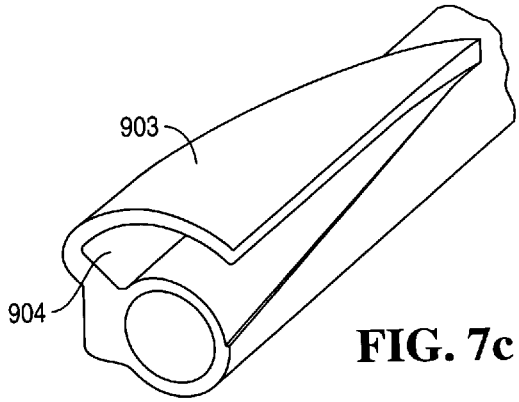
FIG. 7c

MEDIA CASSETTE PUSHER PLATE LOCKING MECHANISM

The present invention relates to a media cassette pusher plate locking mechanism. It is particularly related to, but in no way limited to, media cassettes for storing valuable media in sheet form, such as media cassettes for use in self-service terminals (SSTs) and currency cassettes for use in Automated Teller Machines (ATMs).

BACKGROUND OF THE INVENTION

Currency cassettes provide ATMs with a source of banknotes, and are strong metal or plastics boxes comprising a lid releasably coupled to a body. One end of the body includes a covered aperture that is automatically opened when the cassette is inserted into a currency dispenser, and automatically closed when the cassette is removed from the currency dispenser. The opposite end of the body includes a handle for carrying the cassette, and to aid insertion and removal of the cassette. When a cassette is inserted into a currency dispenser, only the handle end of the cassette is visible.

Vacuum picking systems are used in some automated teller machines to pick banknotes or other media from such cassettes. Vacuum systems include some form of pump mechanism for sucking air through a tube, which has a suction cup on its end. The suction cup is located on the end of a movable pick arm. In use, the arm and associated suction cup is moved into contact with a banknote, at the front of a stack of notes in the cassette, so that the suction created by the pump causes the banknote to adhere to the cup.

Also associated with each arm is gearing or other mechanical means for moving the end of the arm into contact with the banknote, and then towards a transport means which feeds the notes to a dispensing location from which a user can collect the dispensed banknotes. This gearing is normally powered by an AC motor.

There is a known problem with pick mechanisms (such as vacuum pick and friction pick mechanisms), known as double picking, when more than one note at a time is picked from the note stack. This problem is caused, in particular, by worn or poor quality notes. In addition, the use of polymer notes exacerbates this problem.

Double picking of notes causes detrimental performance in ATM cash dispensers and results in overfilling of purge bins, to which double picked notes are diverted, requiring intervention by an ATM engineer.

More recently there has become an increasing need to reduce the amount of space taken up by the media cassette itself within an ATM or self-service terminal (SST) as a whole. This is because of space restrictions at locations where ATMs and SSTs are provided. In addition, when media cassettes are in transit or storage before being inserted into ATMs or SSTs there is also a need to conserve space.

Other problems relate to the filling of the media cassettes themselves for example, to load bank notes into the media cassette. If the media cassette is overfilled this can cause problems with picking of media from the cassette because double-picking is more likely to occur for example. ATM operatives are often tempted to overfill the media cassettes thinking that this will save time and replenishment costs, whilst in reality it often leads to more problems and increased service costs.

As mentioned above, media cassettes are often transported and moved about before being inserted into a pick unit within a dispenser of an ATM or SST. For example, they are loaded in and out of vehicles during transit from a bank to an ATM or SST location. During such transit there is a need to secure stacked media within the cassette to prevent this stack from moving and becoming disarrayed. Previously this has been achieved by using a pusher plate to urge the stack of media items to one end of the cassette and to lock this pusher plate into position during transit of the whole cassette.

There is also a need to retain some small degree of flexibility and movement in the media stack when the cassette is installed in the ATM or SST and is in use.

During this time, it is important to have some flexibility and movement in the media stack to reduce the likelihood of double-picking and other problems with the picking mechanism. Previously, this has been achieved by releasing the pusher plate when the cassette is installed in an ATM, SST or the like.

During transportation of media cassettes there is also a risk that the media cassette will be dropped on its end or body. This can cause problems with the pusher plate locking mechanism, causing it to unlock and possibly become damaged.

The invention seeks to provide an improved media cassette pusher plate locking mechanism which addresses or at least mitigates one or more of the problems mentioned above.

SUMMARY OF THE INVENTION

The invention also seeks to provide an improved method of locking a media cassette pusher plate which addresses or at least mitigates one or more of the problems mentioned above.

During transit of media cassettes there is a need to secure stacked media within the cassette to prevent this stack from moving and becoming disarrayed. Previously this has been achieved by using a pusher plate to urge the stack of media items to one end of the cassette and locking that pusher plate during transit. A ratchet bar is provided in the media cassette lid which engages with the pusher plate assembly to lock it during transit. The ratchet bar is coupled to a cam which is arranged to engage with a cam actuator in the dispenser when the media cassette is loaded into an ATM or similar. When the media cassette is inserted into the dispenser the cam automatically drives the ratchet bar which rotates and in so doing disengages the pusher plate assembly. By housing the ratchet bar in the media cassette lid, space savings are achieved and in addition, users are prevented from using the pusher plate locking mechanism to facilitate overfilling of the media cassette. In a preferred embodiment two ratchet bars are used, one positioned along the inside edge of each long side of the media cassette lid. In addition, by locating the ratchet bars in the media cassette lid an improved mechanical advantage is included. This reduces the risks of the pusher plate locking mechanism unlocking if the media cassette is dropped, especially on its end.

A media cassette pusher plate locking mechanism comprising:

- a ratchet bar arranged to be mounted in the media cassette in use such that it is rotatable about its longitudinal axis between a transit position, in which the bar engages a pusher plate assembly to lock that pusher plate, and an active position in which the ratchet bar is disengaged from the pusher plate assembly such that the pusher plate is released;
- means for resiliently biasing said ratchet bar into the transit position; and
- a cam coupled to the ratchet bar and arranged to engage in use with a dispenser into which the media cassette is inserted, said cam being formed to urge the ratchet bar into the active position on insertion of the cassette into the dispenser.

The invention also encompasses a media cassette comprising a media cassette pusher plate locking mechanism as described above. In addition, the invention encompasses an automated teller machine comprising such as a media cassette.

According to another aspect of the invention there is provided a method of releasing a pusher plate in a media cassette, said media cassette having a ratchet bar resiliently biased into a transit position, a cam coupled to the ratchet bar, and a pusher plate assembly arranged to engage the ratchet bar in the transit position; said method comprising:

inserting the media cassette into a dispenser such that the cam engages with the dispenser; and wherein said action of engaging the dispenser with the cam causes the ratchet bar to rotate about its longitudinal axis from the transit position in which the bar engages the pusher plate assembly to lock that pusher plate, to an active position in which the ratchet bar is disengaged from the pusher plate assembly such that the pusher plate is released.

Preferably, the media cassette pusher plate locking mechanism ratchet bar comprises a plurality of teeth arranged in a row substantially along a line of longitude of the ratchet bar.

Preferably, that ratchet bar comprises an annular groove arranged to hold a coil spring and the means for resiliently biasing the ratchet bar comprises that coil spring.

Preferably, the ratchet bar comprises a smooth surface running substantially along a line of longitude of the bar. For example, that line of longitude is positioned about 90 degrees from that of the row of teeth.

Preferably the cam comprises a curved, tapered, flange extending around at least part of the ratchet bar.

The media cassette lid preferably comprises an aperture arranged to allow a finger on a dispenser into which the media cassette is inserted, to engage the cam.

Preferably the method of releasing the pusher plate further comprises disengaging the pusher plate assembly from the ratchet bar by opening the media cassette.

The preferred features may be combined as appropriate, as would be apparent to a skilled person, and may be combined with any of the aspects of the invention.

BRIEF DESCRIPTION OF THE DRAWINGS

These and other aspects of the invention will be apparent from the following specific description, given by way of example, with reference to the accompanying drawings, in which:

FIG. 7*a* is a perspective view of an end of a ratchet bar of FIG. 8;

FIG. 7*b* is a perspective view of a ratchet bar;

FIG. 7*c* is a perspective view of a cam end of the ratchet bar of FIG. 9*b;*

Like reference numerals are used to designate like parts in the accompanying drawings.

DETAILED DESCRIPTION

Figure 1:
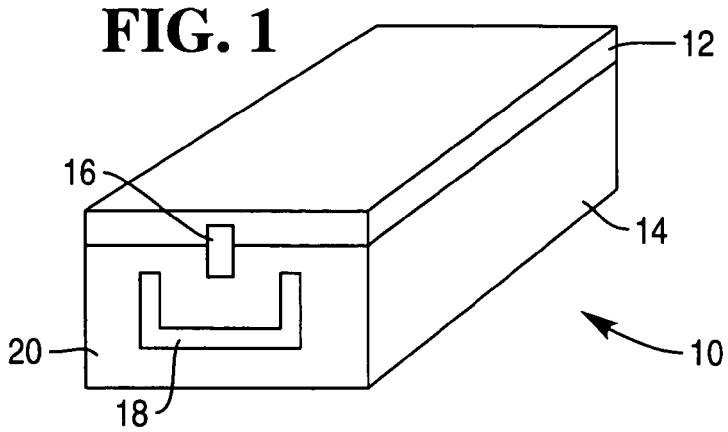
FIG. 1 is a schematic perspective view of a media cassette.
Figure 2:
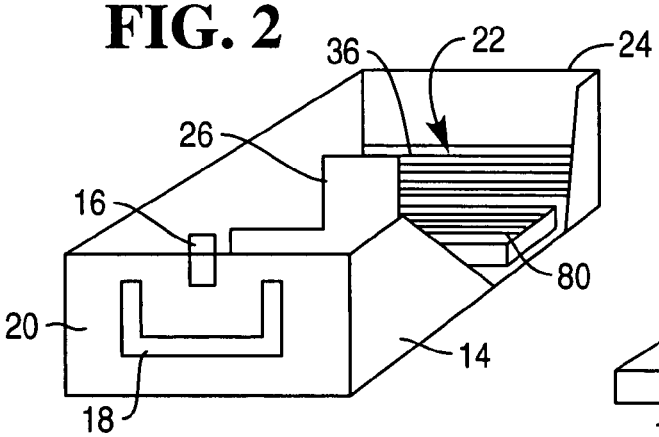
FIG. 2 is schematic perspective view of a body portion of the interior of the media cassette of FIG. 1.
Figure 3:
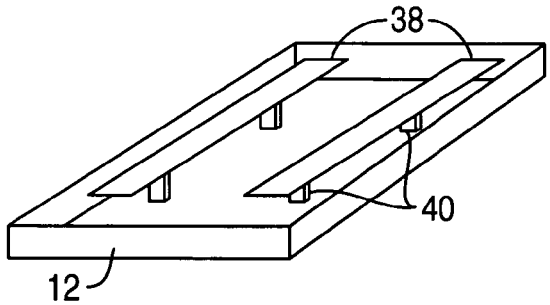
FIG. 3 is a schematic perspective underside view of a lid portion of the media cassette of FIG. 1.

Embodiments of the present invention are described below by way of example only. These examples represent the best ways of putting the invention into practice that are currently known to the Applicant although they are not the only ways in which this could be achieved.

The term "cam" is used herein to refer to a projecting part of a rotating shaft that is formed to strike another entity at one or more points on its circular path. The cam can be though of as a device that translates motion between circular motion and linear motion.

Referring to FIGS. 1 to 4, a media cassette 10, in the form of a polycarbonate currency cassette for storing banknotes or other media items, has a lid 12 secured to a body 14 by a latch 16 or any other suitable means. The body 14 has a handle 18 pivotably mounted at a handle end 20, and a pick area 22 at a pick end 24 opposite the handle end 20.

A pusher plate 26 is mounted on rails on each side of the cassette body, extending from the handle end 20 to the pick end 24, and is urged towards the pick end 24 by a resilient member (not shown). The pusher plate 26 is made of metal or other suitable material and is mounted above two lateral guides 30, 32 for guiding opposite short edges of banknotes 34 or other media as the banknotes are urged towards the pick end 24.

The body 14 has a roller shutter 36 covering the pick area 22, so that when the cassette 10 is inserted into an ATM or other SST (not shown), metal fingers in the ATM engage with recesses (not shown) in the body 14, and the roller shutter 36 is automatically lowered by the metal fingers (or tines) to allow banknotes 34 to be picked from the pick area 22 by a media dispenser pick unit in the ATM. When the cassette 10 is removed from the ATM 100, the tines in the ATM disengage from the recesses (not shown) in the body 14, and the roller shutter 36 is urged upwards to cover the pick area 22 and prevent access to the banknotes 34 in the cassette 10.

The underside of the lid 12 includes two banknote long-edge aligners 38 mounted in slots in lid 12. The aligners 38 prevent banknotes 34 stored within the cassette 10 from moving towards the lid 12 during transportation.

FIGS. 5 to 16 illustrate a preferred embodiment of the invention in which ratchet bars are used to provide a media cassette pusher plate locking mechanism. Fingers or tines 502 (also referred to as cam actuators) in a dispenser are used to automatically release the locking mechanism when the media cassette is inserted in the dispenser. This provides a simple and effective means of locking and unlocking the pusher plate. In addition, the ratchet bars can be accommodated in a lid of the media cassette (although this is not essential) in order to reduce the height of the media cassette (distance between the top of the lid and the bottom of the body). This also provides the advantage that when the media cassette lid is removed, in order to load bank notes into the cassette body for example, it is not possible to use the ratchet bar mechanism to assist in packing media into the cassette. This helps to prevent overfilling of the cassette.

Figure 5:
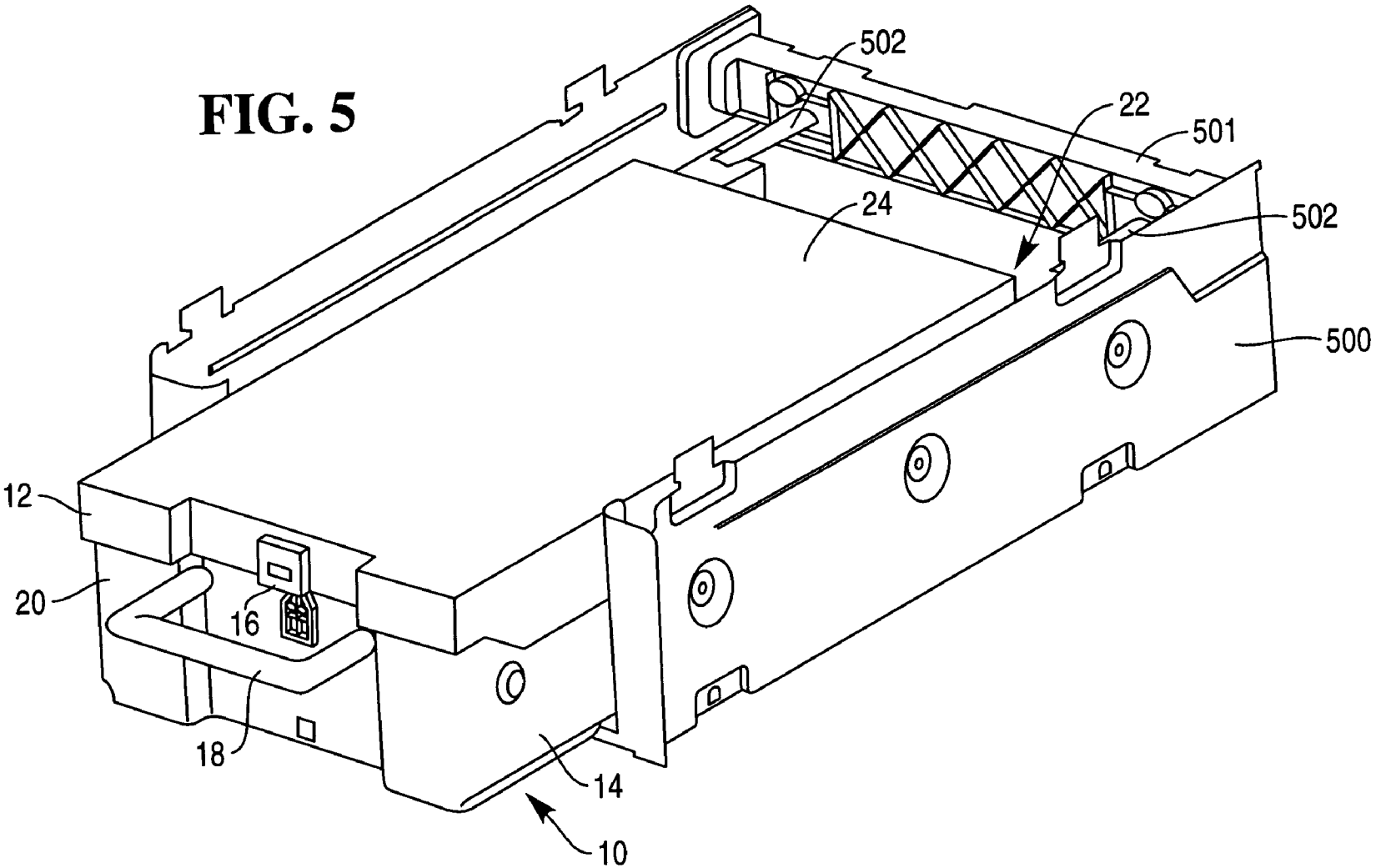
FIG. 5 is a perspective view of a media cassette being inserted into a dispenser pick unit.

FIG. 5 shows a media cassette with a lid 12 on the body 14 and indicates how the media cassette is inserted into a pick unit 500 of a dispenser such as an ATM, SST or other dispenser unit. The pick unit 500 has a back plate 501 from which two fingers 502 protrude into a space arranged to house the media cassette.

Figure 6:
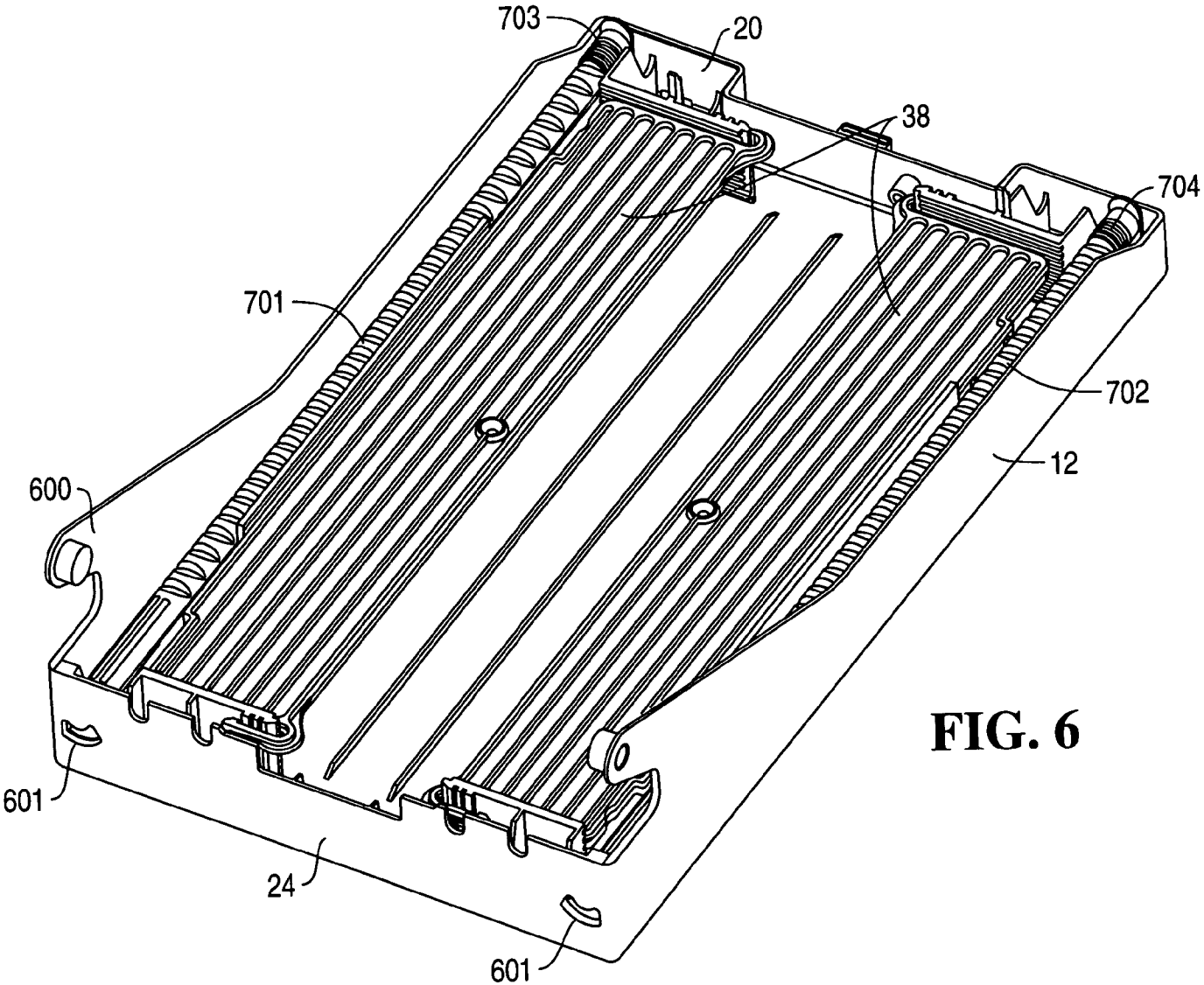
FIG. 6 is a perspective view of the underside of a lid of the media cassette of FIG. 5.

FIG. 6 shows the underside of the lid of the media cassette of FIG. 5. This has two arms 600 which are used to hinge the lid onto the body of the cassette. However, this is not essential. The lid can be mounted onto the cassette body in any suitable manner. The pick end 24 of the lid comprises two apertures 601 arranged to receive the fingers 502 of the dispenser pick unit 500.

Two ratchet bars 701, 702 are mounted within the lid. These are mounted in parallel with the longitudinal axis of the lid, one along the inside of each long edge of the lid. Each ratchet bar is about the same length as the length of the lid and is rotatably mounted about its longitudinal axis such that it is able to rotate in this manner though about 90 degrees. Each ratchet bar is resiliently biased by a spring 703, 704 or other suitable resilient biasing means. In the embodiment shown, coil springs are used although any other suitable type of spring may be used. The resilient biasing means is arranged to bias the ratchet bars into a home position also referred to herein as a transit position. This position is the one in which the pusher plate can be locked such that the media cassette can be transported without disturbing bank notes or other items stacked in the cassette.

FIGS. 7*a*, 7*b* and 7*c* illustrate the ratchet bar. This is preferably formed from plastics material using injection molding techniques although it can be manufactured in any other suitable manner. The ratchet bar comprises an annular groove 900 arranged to hold a coil spring as illustrated in FIG. 6. The coil spring preferably has an end projection extending parallel with the longitudinal axis of the coil and this is held in a groove 901 in the ratchet bar.

The ratchet bar has a plurality of teeth 902 arranged along most of the length of the bar, substantially along a line of longitude of the bar. A smooth surface is also provided, again running along most of the length of the bar and also substantially along a line of longitude of the bar. This smooth surface region is preferably located about 90 degrees around the bar from the row of teeth although this is not essential. The bar comprises recesses in order to facilitate manufacture by injection molding as well as to reduce weight whilst retaining strength.

A cam 903 is provided on the ratchet bar and this is preferably coupled to the bar at the end opposite the spring end although this is not essential. The spring and the cam can be provided at any suitable location on the ratchet bar.

Preferably the cam 903 takes the form of a curved flange extending around at least part of the ratchet bar and tapering away from the end of the ratchet bar. A recess or groove 904 is thus created between the flange and the ratchet bar which is designed to accept a finger 502 from the dispenser pick unit. As the finger 502 is inserted into this recess it causes the ratchet bar to rotate about its longitudinal axis.

Figure 8:
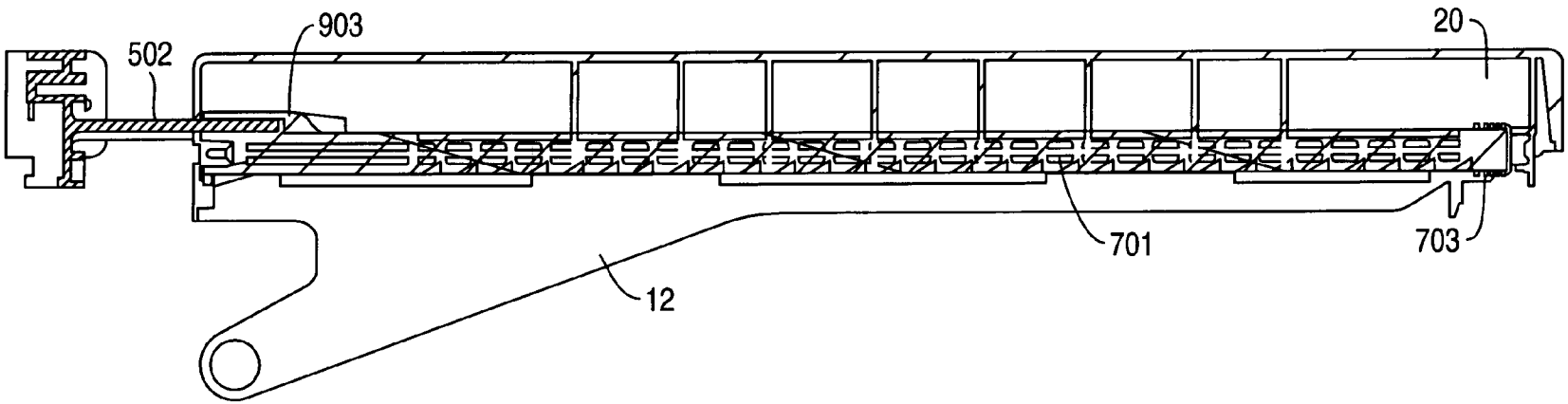
FIG. 8 is a cross section through a media cassette lid and part of a dispenser pick unit, with the media cassette lid inserted into the dispenser pick unit.
Figure 10:
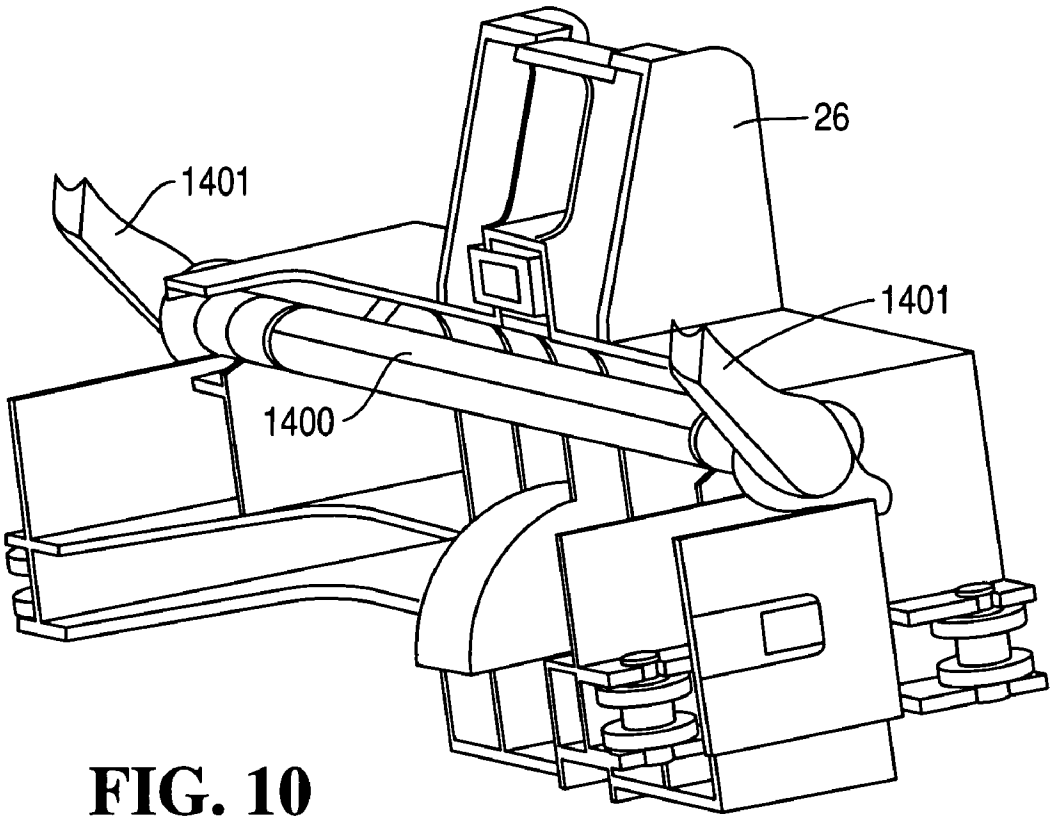
FIG. 10 is a perspective view of a pusher plate mechanism for use with the media cassette lid of FIG. 6.

FIG. 8 is a cross section through the media cassette lid 12 of FIG. 10. It shows a finger 502 on the dispenser activating the cam 903 in order to release the pusher plate locking mechanism.

Figure 9:
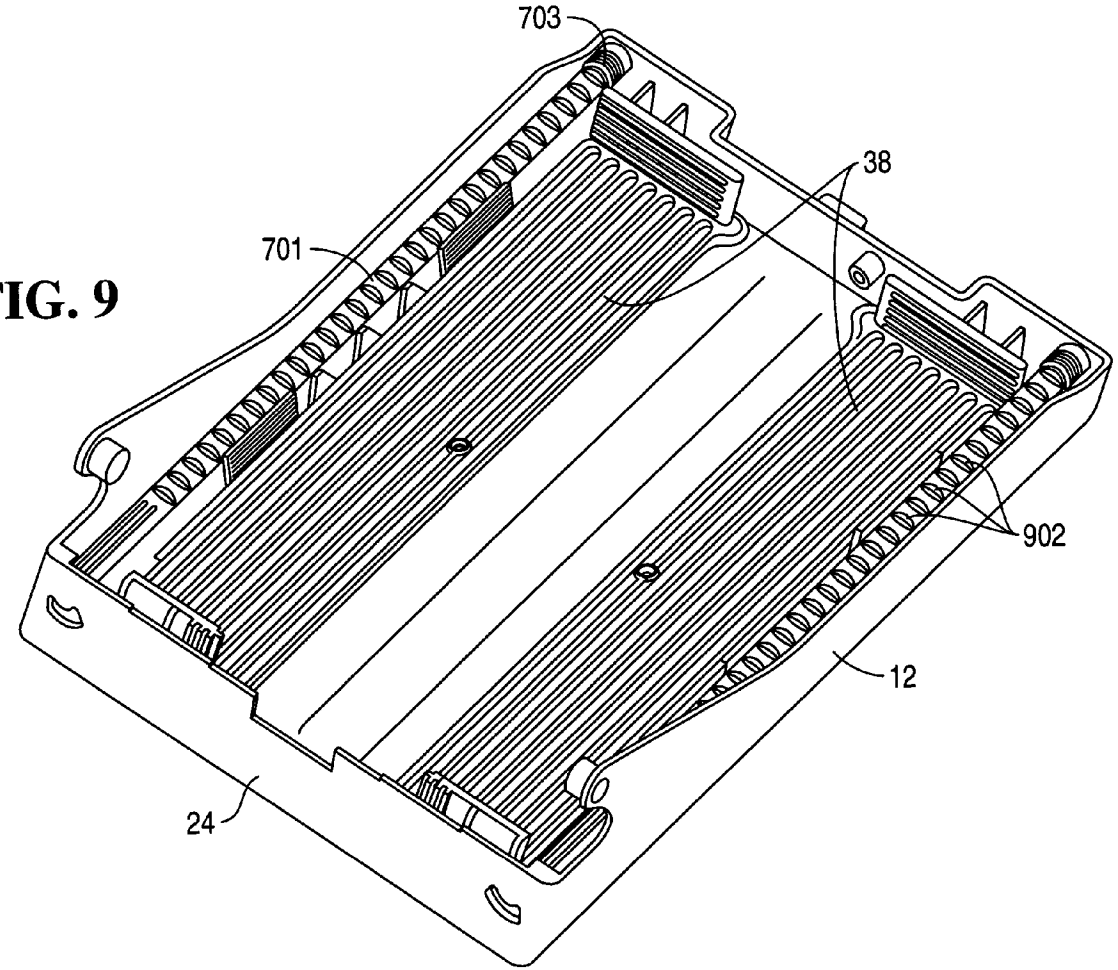
FIG. 9 is a perspective view of the underside of a media cassette lid with the toothed parts of the ratchet bars exposed.

FIG. 9 is a perspective view of the underside of the media cassette lid 12 showing the ratchet bars with their rows of teeth 902 exposed. This is the orientation of the ratchet bars in when the media cassette is arranged for transit, i.e. when the pusher plate locking mechanism is locked.

FIG. 10 is a perspective view of the pusher plate assembly 26 which may be formed as a molding. A bar 1400 is rotatably mounted on the pusher plate assembly and has one or more arms 1401 extending therefrom. The arms 1401 are preferably integral with the bar 1400 although this is not essential. In the example shown one arm 1401 extends from each end of the bar and each arm is fixed to the bar. Thus when the bar rotates the arms 1401 also rotate with the bar. The bar is resiliently biased into a home position in which the arms extend generally upwards.

Figure 11:
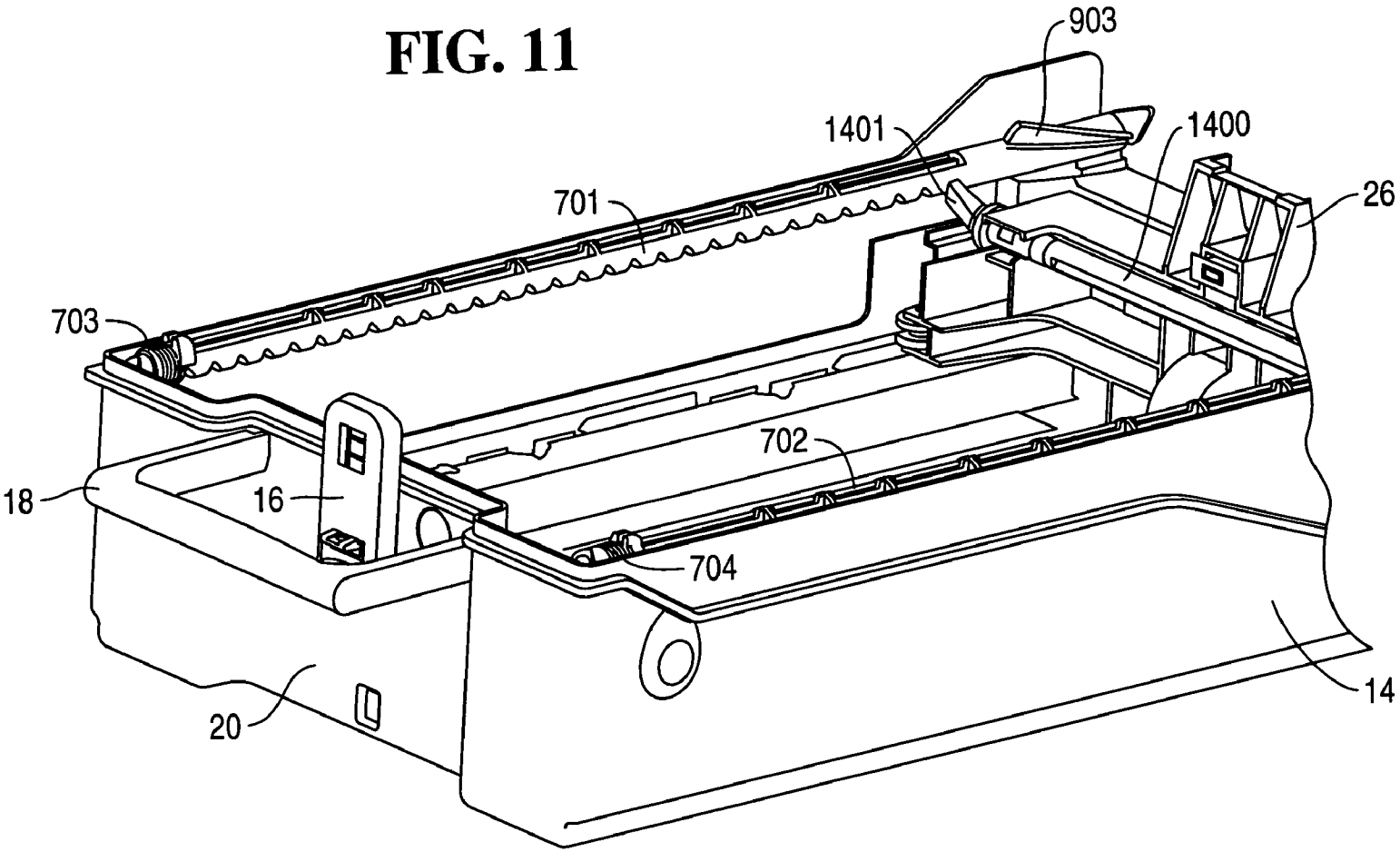
FIG. 11 is a partial view in perspective of a body of the media cassette of FIG. 5 showing the pusher plate mechanism of FIG. 10 engaged with the ratchet bars.

FIG. 11 shows part of the media cassette body 14. The pusher plate assembly 26 of FIG. 10 is shown housed in the media cassette body 14. The pusher plate assembly 26 is slidably mounted on two side rails, one at each side of the cassette body 14 as explained with reference to FIG. 4. Resilient biasing means is provided so that the pusher plate 26 tends to urge stacked bank notes towards the pick end of the cassette. Any suitable means for mounting the pusher plate assembly and for providing the resilient biasing means can be used.

As shown in FIG. 11 each arm 1401 of the pusher plate structure is arranged to engage with a tooth on one of the ratchet bars during the transit or locked state. The ratchet bars 701, 702 shown in FIG. 11 are in fact housed in the media cassette lid rather than the body. They are shown in FIG. 11 without the lid structure present for reasons of clarity.

When the media cassette is inserted into a dispenser and fingers 502 are inserted through apertures 601 and into cams 903 the ratchet bars 701, 702 rotate such that the teeth disengage from the arms on the pusher plate structure. The arms of the pusher plate structure now abut against a smooth surface of the ratchet bars so that there is some small degree of flexibility or play in the pusher plate mechanism.

Figure 4:
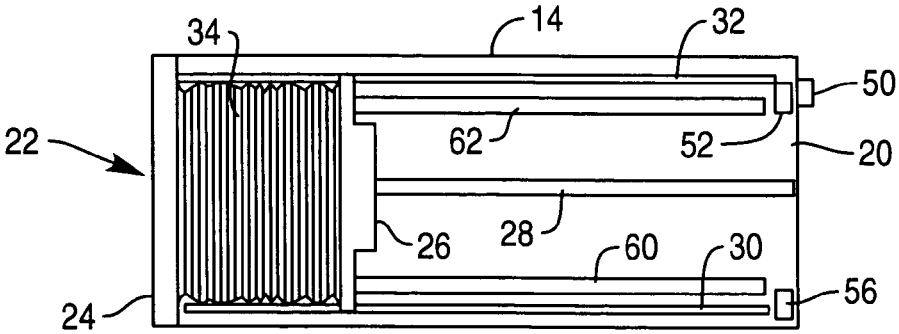
FIG. 4 is a schematic plan view of the body portion of the media cassette of FIG. 2.
Figure 12:
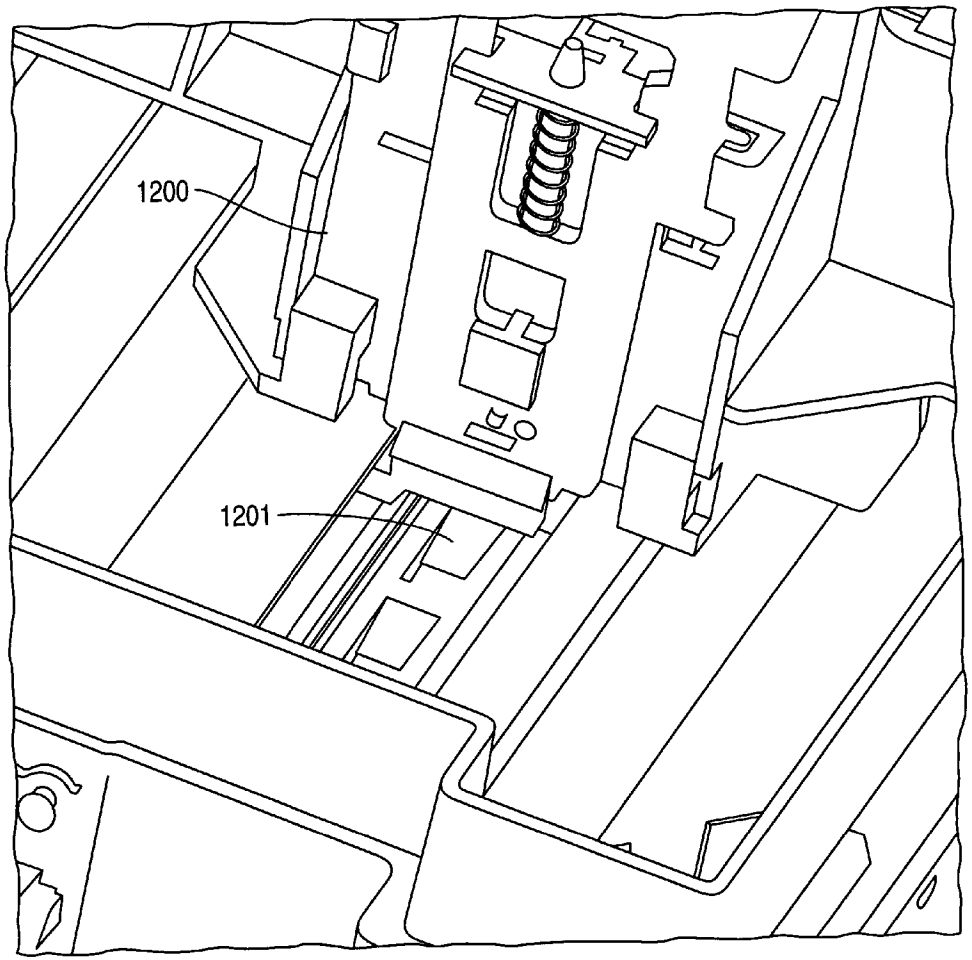
FIG. 12 PRIOR ART
FIG. 12 shows part of a prior art cassette body.

FIG. 12 shows part of a prior art cassette body with a pusher plate assembly 1200 mounted over a ratchet 1201 similar to that of FIG. 4. The roller door of the cassette is linked to the ratchet 1201. When the roller door is closed, the ratchet 1201 is raised into a position where it engages with a peg on the under side of the pusher plate assembly 1200. This engagement limits the movement of the pusher plate assembly 1200, so that the notes in the cassette are constrained when the cassette is in transit. If such a media cassette, loaded with notes and locked in the transit position, is dropped on its end (such as the pick end) there is a danger that the pusher plate will bend and the pusher plate locking mechanism becomes unlocked.

Figure 13:
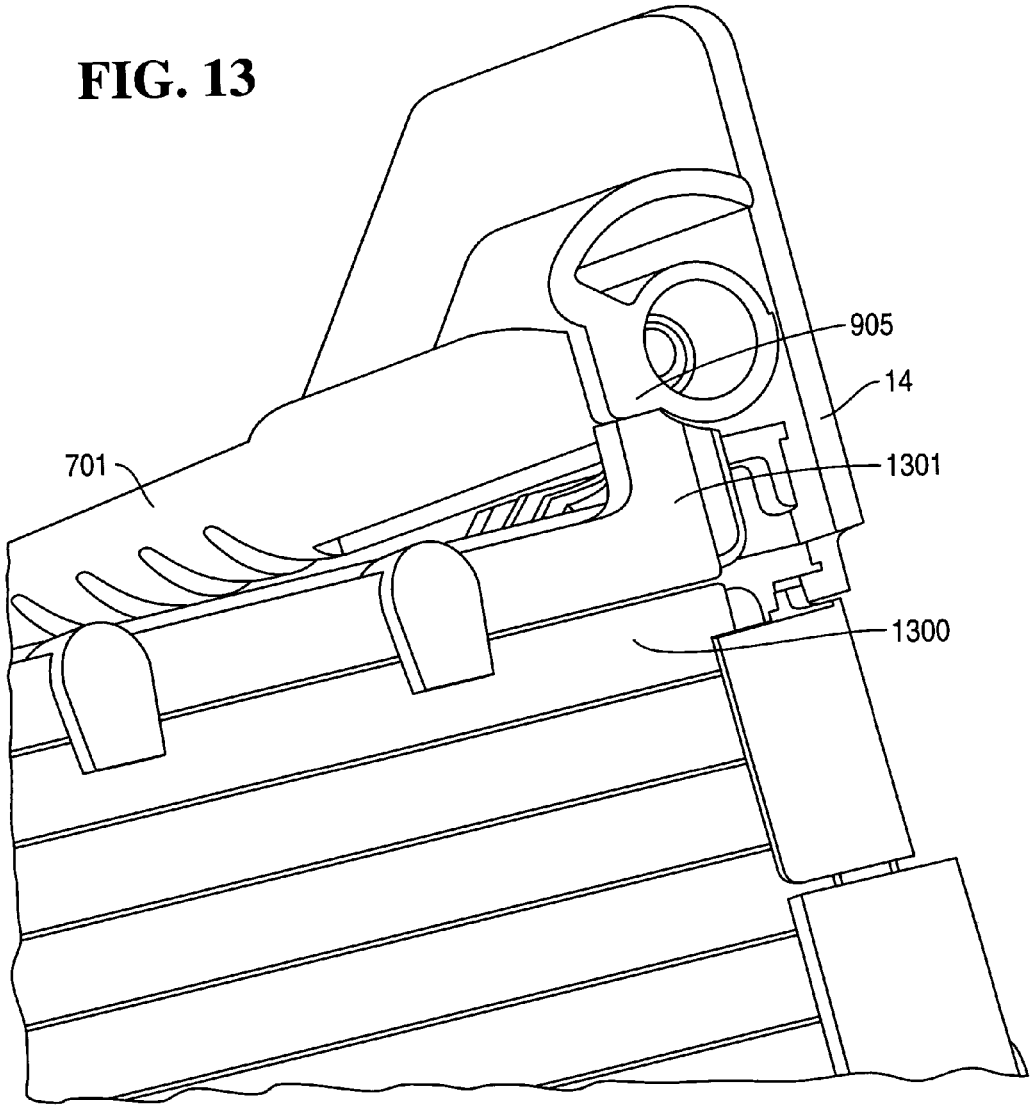
FIG. 13 shows part of a media cassette body with a roller door.

FIG. 13 shows a media cassette body according to an embodiment of the present invention. At the pick end of the media cassette a roller door 1300 is provided as mentioned earlier in this document. A shaped projection 1301 is provided on each top corner of this roller door, each projection 1301 being arranged to abut a ratchet bar in the media cassette lid. The diagram in FIG. 13 shows one such ratchet bar from the lid, without the lid itself, for clarity. The ratchet bar has a projection 905 which is arranged to abut the projection 1301 of the roller door. The ratchet bar projection 905 is suitably positioned on the ratchet bar such that when the roller door is shut the ratchet bar is held in the transit position. This provides the advantage that if the coil spring is unable to hold the ratchet bar in its transit position securely (for example, if the coil spring weakens with use or if the cassette is dropped) then the additional roller door projections ensure the transit position is maintained. Also, if the coil spring 703 weakens such that it does not fully bias the ratchet bar into its home 'transit' position, then the projection on the roller door assists in rotating the ratchet bar fully. For example, if the ratchet bar is rotated say 85° from the active position towards the transit position, then, when the roller door is closed, the projection 1301, of the roller door moves against the ratchet bar surface, causing it to rotate further until it reaches the transit position.

In summary, by locating the ratchet bars in the lid rather than the cassette body space savings are achieved. In addition, a better mechanical advantage is provided so that when the loaded cassette is dropped on its end there is less risk of the pusher plate locking mechanism unlocking. Also, operators are unable to overfill the cassette so easily because the ratchet bars cannot be used to facilitate overfilling.

Any range or device value given herein may be extended or altered without losing the effect sought, as will be apparent to the skilled person.

It will be understood that the above description of a preferred embodiment is given by way of example only and that various modifications may be made by those skilled in the art.

What is claimed is:

1. A media cassette pusher plate locking mechanism comprising:

(i) a ratchet bar arranged to be mounted in the media cassette in use such that it is rotatable about its longitudinal axis between a transit position, in which the bar engages a pusher plate assembly to lock a pusher plate, and an active position in which the ratchet bar is disengaged from the pusher plate assembly such that the pusher plate is released;

(ii) a biasing mechanism for resiliently biasing the ratchet bar into the transit position; and (iii) a cam coupled to the ratchet bar and arranged to engage with a dispenser into which the media cassette is inserted, the cam being formed to urge the ratchet bar into the active position on insertion of the cassette into the dispenser;

wherein the ratchet bar comprises a plurality of teeth arranged in a row substantially along a line of longitude of the ratchet bar.

2. A media cassette pusher plate locking mechanism as claimed in claim 1, wherein the ratchet bar comprises an annular groove arranged to hold a coil spring and wherein the biasing mechanism for resiliently biasing the ratchet bar comprises that coil spring.

3. A media cassette pusher plate locking mechanism as claimed in claim 1, wherein said ratchet bar comprises a smooth surface running substantially along a line of longitude of the bar.

4. A media cassette pusher plate locking mechanism as claimed in claim 1, wherein the ratchet bar further comprises a smooth surface running substantially along a line of longitude of the bar, that line of longitude being positioned about 90 degrees from that of the row of teeth.

5. A media cassette pusher plate locking mechanism as claimed in claim 1, wherein the cam comprises a curved, tapered, flange extending around at least part of the ratchet bar.

6. A media cassette lid comprising a media cassette pusher plate locking mechanism as claimed in claim 1, further comprising an aperture arranged to allow a finger on a dispenser into which the media cassette is inserted, to engage the cam.

7. A media cassette comprising a media cassette pusher plate locking mechanism comprising:

(i) a ratchet bar arranged to be mounted in the media cassette in use such that it is rotatable about its longitudinal axis between a transit position, in which the bar engages a pusher plate assembly to lock a pusher plate, and an active position in which the ratchet bar is disengaged from the pusher plate assembly such that the pusher plate is released;

(ii) a spring for resiliently biasing the ratchet bar into the transit position; and (iii) a cam coupled to the ratchet bar and arranged to engage in use with a dispenser into which the media cassette is inserted, the cam being formed to urge the ratchet bar into the active position on insertion of the cassette into the dispenser;

wherein the ratchet bar comprises a plurality of teeth arranged in a row substantially along a line of longitude of the ratchet bar.

8. A media cassette as claimed in claim 7, wherein the pusher plate assembly comprises one or more arms formed to engage with teeth in the ratchet bar during the transit position.

9. A media cassette as claimed in claim 8, wherein the arms are also formed to slidably abut a smooth surface of the ratchet bar in the active position.

* * * * *